US007096919B2

(12) United States Patent
Narushima et al.

(10) Patent No.: US 7,096,919 B2
(45) Date of Patent: Aug. 29, 2006

(54) SUBLIMATION PATTERN CASTING METHOD

(75) Inventors: Takeshi Narushima, Tochigi (JP); Yoshio Tomida, Aichi (JP); Masayuki Kato, Aichi (JP); Masahiko Kagitani, Aichi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/490,119

(22) PCT Filed: Nov. 15, 2002

(86) PCT No.: PCT/JP02/11923

§ 371 (c)(1),
(2), (4) Date: Mar. 26, 2004

(87) PCT Pub. No.: WO03/043762

PCT Pub. Date: May 30, 2003

(65) Prior Publication Data

US 2004/0244934 A1 Dec. 9, 2004

(30) Foreign Application Priority Data

Nov. 20, 2001 (JP) ..... 2001-354587

(51) Int. Cl.
*B22C 9/04* (2006.01)

(52) U.S. Cl. ..... 164/34; 164/45

(58) Field of Classification Search ..... 164/34, 164/35, 45, 246

See application file for complete search history.

(56) References Cited

U.S. PATENT DOCUMENTS 3,259,949 A * 7/1966 Moore ..... 164/34
4,711,287 A * 12/1987 Kuwabara et al. ..... 164/34
4,969,505 A * 11/1990 Sanders ..... 164/253
6,189,598 B1 * 2/2001 Chandley et al. ..... 164/34
6,453,976 B1 * 9/2002 Chandley et al. ..... 164/34
6,845,810 B1 * 1/2005 Siak et al. ..... 164/244
2004/0060681 A1 4/2004 Nakai et al.

FOREIGN PATENT DOCUMENTS

| | | |
|---|---|---|
| JP | 5-261470 | 10/1993 |
| JP | 8-206777 | 8/1996 |
| JP | 11-90583 | 4/1999 |
| JP | 2002/219552 | 8/2002 |
| WO | WO 02/42022 A1 | 5/2002 |

* cited by examiner

*Primary Examiner*—Len Tran
(74) *Attorney, Agent, or Firm*—Oblon, Spivak, McClelland, Maier & Neustadt, P.C.

(57) ABSTRACT

An evaporative pattern casting process in which a casting process plan capable of attaining the optimal discharge of generated gas can easily be decided. The evaporative pattern casting process can cast a product, and includes pouring a molten metal in a mold in which a pattern made of an expanded synthetic resin is embedded in molding sand, and evaporating the pattern with the molten metal, while gas generated by evaporation of the pattern is discharged outside the mold through a discharging passage including discharged gas suppressing device. The ventilation of the discharging passage is controlled on the basis of the material, the shape of the pattern, the kind of the molten metal, and the temperature of the molten metal.

11 Claims, 6 Drawing Sheets

SAMPLE 1

SAMPLE 2

Runner and through holes inside the gates.

SUBLIMATION PATTERN CASTING METHOD

TECHNICAL FIELD

The present invention relates to an evaporative pattern casting process, in particular, an evaporative pattern casting process wherein casting is performed while gas generated by evaporating a pattern is discharged outside a mold through a discharging passage.

PRIOR ARTS

The evaporative pattern casting process is also called the full mold casting process, and is a process using a pattern produced from an expanded synthetic resin as a mold in the state that the pattern is embedded in molding sand. In this process, the expanded synthetic resin is thermally decomposed by a cast, molten metal. However, this process has drawbacks that a large amount of thermal decomposition gas including soot is generated to deteriorate environment on the basis of the generation of bad smell, and further residues thereof generate casting defects in the resultant casting.

The evaporative pattern casting process has many advantages such that casting can easily be attained. However, the method has drawbacks that a casting defect is generated by bad adjustment of gas vent; and sand cannot be sufficiently filled into a pattern because the pattern has a low strength and the pattern is easily damaged, and the packing density of the filled sand is small, so that shortage of the strength of the mold and burning are caused.

As techniques about the gas vent, JP-A 5-261470 discloses a method of setting a ventilation passage connected to an air outlet inside a pattern. JP-A 8-206777 discloses a method of discharging generated gas outside through molding sand forcibly while sucking outer air. JP-A 11-90583 also discloses an evaporative pattern casting process capable of discharging generated gas smoothly outside a mold.

DISCLOSURE OF THE INVENTION

As described above, the quality of casing is improved to some degree by discharging generated gas forcibly. However, disturbance of the molten metal inside the mold is caused. Thus, intentions cannot be necessarily attained. The material, the shape, and the size of the pattern may vary, and the amount of gas generated by thermal decomposition of the pattern is also largely varied for each casting. Thus, the quality thereof may not be improved. It is therefore considered that if a casting process plan making it possible to attain the optimum discharge of generated gas is easily decided, the utility value thereof in the art is very high.

The present invention relates to an evaporative pattern casting process for casting a product, which comprises pouring a molten metal in a mold in which a pattern made of an expanded synthetic resin is embedded in molding sand, and evaporating the pattern with the molten metal, while gas generated by evaporation of the pattern is discharged outside the mold through a discharging passage comprising a discharged gas suppressing means, wherein the ventilation of the discharging passage is controlled on the basis of the material and the shape of the pattern and the kind of the molten metal and the temperature of the molten metal.

The present invention also relates to an evaporative pattern casting process for casting a product, which comprises pouring a molten metal in a mold in which a pattern made of an expanded synthetic resin is embedded in molding sand, and evaporating the pattern with the molten metal, while gas generated by evaporation of the pattern is discharged outside the mold through a discharging passage comprising a discharged gas suppressing means satisfying the following formula (1):

$$0.3\,K^* \leqq K \leqq 10\,K^* \tag{1}$$

[wherein K* is defined as follows:

$$K^* = \sqrt{2}c\alpha S_c/\sqrt{\rho} \tag{2}$$

ρ: density (kg/m$^3$) of the molten metal, c: flow coefficient 0.3,

α: magnifying power of the volume when the pattern is evaporated, and $S_c$: sectional area (m$^2$) of a passage for the molten metal, and K is a constant decided by applying the result of a ventilation test to the following formula (3) on the basis of the method of least squares:

$$Q = K\sqrt{p} \tag{3}$$

Q: flow rate (m$^3$/s) of the gas discharged from the discharging passage comprising the discharged gas suppressing means, and p: pressure loss (Pa) in the discharging passage comprising the discharged gas suppressing means.]

The present invention also relates to a method of controlling the ventilation of the discharging passage on the basis of the material and the shape of the pattern and the kind of the molten metal and the temperature of the molten metal in an evaporative pattern casting process for casting a product, which comprises pouring a molten metal in a mold in which a pattern made of an expanded synthetic resin is embedded in molding sand, and evaporating the pattern with the molten metal, while gas generated by evaporation of the pattern is discharged outside the mold through a discharging passage comprising a discharged gas suppressing means.

In the present invention, the ventilation of the discharging passage is controlled on the basis of at least the material and the shape of the pattern, the kind of the molten metal, and the temperature of the molten metal. Preferable is a controlling method for controlling the ventilation of the discharging passage on the basis of the above-mentioned formula (1).

Figure 1:
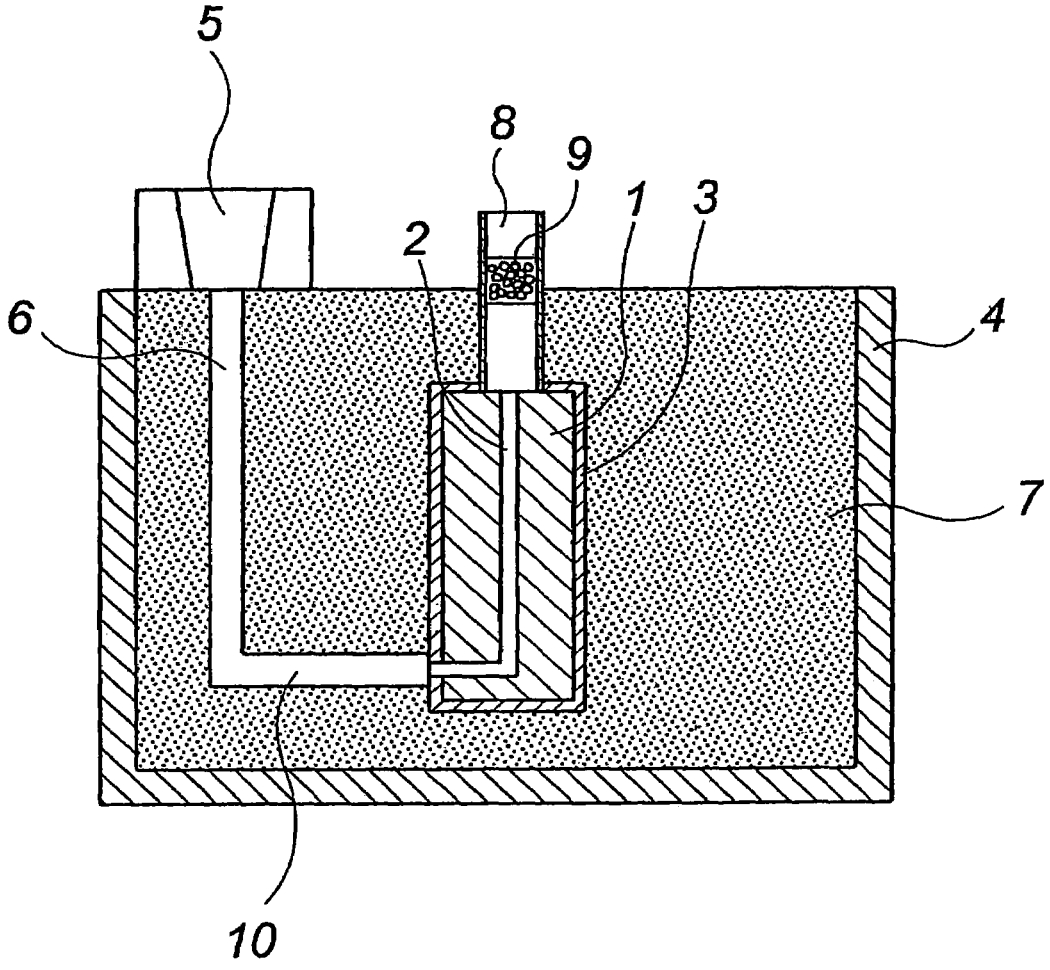
FIG. 1 is a schematic view illustrating one example of the evaporative pattern casting process of the present invention.

Reference numbers in the drawings are described. 1 pattern, 2 through holes, 8 discharging passage and 9 refractory material particle.

DETAILED DESCRIPTION OF THE INVENTION

The outline of the evaporative pattern casting process of the present invention will be described on the basis of FIG. 1. A mold is composed of a molding flask 4, a molding sand 7 inside the molding flask 4, a pattern 1 embedded in the molding sand 7 and others, and a pouring cup 5 connected to the pattern 1 is set at the upper left. The pattern 1 is made of expanded polystyrene to have the same shape as a product. A through hole 2 is made therein. The molding sand 7 is silica sand (AFS-GFN=50), in which an appropriate amount of a binder is incorporated. For the formation of the mold, a coating material 3 excellent in fire-resistance is first applied on to the surface of the pattern 1, and subsequently the coating material is sufficiently dried. A sprue 6 and a runner 10 are made in the molding flask 4, and then the pattern 1 is fixed and the molding sand 7 is embedded therein. The pouring cup 5 is set up. At this time, the inside of the through hole 2 is made into a space, and the through hole 2 is connected to the runner 10 and further a discharging pipe connected to the through hole 2 is set up to prepare a discharging passage 8. The discharging pipe, which becomes the discharging passage 8, is made of a ceramic, and is filled with refractory material particles 9 made of alumina or the like, which is molded with a binder, as a discharged gas suppressing means. The pipe is embedded in the molding sand 7 so as to connect the through hole 2 to the atmosphere.

When a molten metal is poured from the pouring cup 5, the molten metal reaches the pattern 1 through the sprue 6 and the runner 10 so as to cause the pattern 1 to be molten and remain inside the mold. On the other hand, it is confirmed that gas of the pattern 1 molten and burned by the molten metal is discharged from the discharging passage 8. The discharge of the gas is adjusted since the passage is filled with the refractory material particles.

In this way, in the present invention the gas generated by the burning and evaporating the pattern (hereinafter referred to as the generated gas) is not forcibly discharged at the same time when the gas is generated, but the gas is gradually discharged while the discharge amount thereof is suppressed. By discharging the generated gas outside the mold gradually in this way, the disturbance of the molten metal in the mold can be controlled. The discharged gas suppressing means is a means having a ventilation capable of discharging the generated gas outside gradually by the setup of this means, and is preferably made of refractory material particles and a layer thereof, a back pressure valve, or a hollow fine tube. The means is more preferably made of refractory material particles and a layer thereof or a back pressure valve from the viewpoint of preventing the molten metal from being blown out, and is still more preferably made of refractory material particles and a layer thereof from the viewpoint that they also have a function of filtrating soot.

The present inventor has found out that in the case of using a discharged gas suppressing means as described above in an evaporative pattern casting process, the optimum ventilation that the discharged gas suppressing means should have is varied by the material of the pattern, the form thereof, such as the size or the shape thereof (that is, the form of the casting), the kind of the molten metal (that is, the kind of the casting material) or the temperature of the molten metal (that is, the casting temperature). Furthermore, the inventor has found out a method making it possible to decide easily this casting process plan capable of obtaining the optimum ventilation. That is, in the present invention, a runner and a discharging passage are connected to each other, and further the ventilation of the discharging passage is controlled. Specifically, it has been found out that a good casting product can be obtained, regardless of the material and the shape of a pattern, by controlling the ventilation of the discharging passage on the basis of at least the material and the shape of the pattern, the density of the above-mentioned molten metal decided by the kind of the molten metal and the temperature of the molten metal, the sectional area of a passage for the molten metal, and the magnifying power of the volume when the pattern is evaporated, and further by controlling the ventilation of the discharging passage to satisfy the following formula (1).

Figure 2:
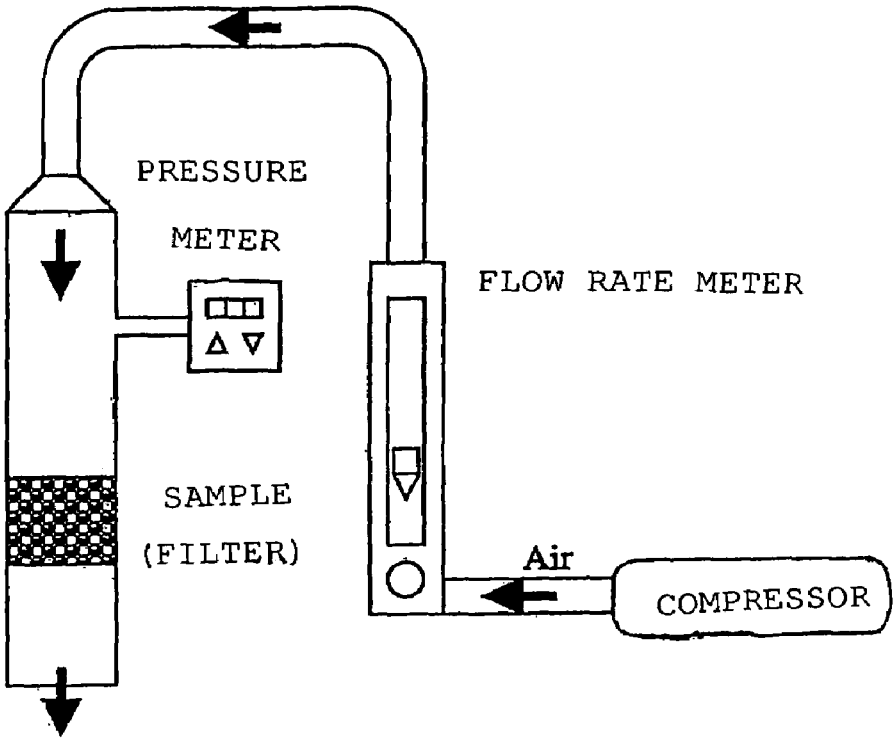
FIG. 2 is a schematic view of a device for measuring discharged gas flow rate Q (m$^3$/s) and pressure loss p (Pa) in a discharged gas suppressing means.

Besides the method of controlling the ventilation of the discharging passage as described above, the inventor has also found out that it is possible to provide an evaporative pattern casting process wherein a discharged gas suppressing means which satisfies the above-mentioned formula (1) is used, whereby a good casting quality can be obtained in the same way regardless of the material and the shape of a pattern. A specific structure of such a discharged gas suppressing means which satisfies the formula (1) can easily be decided from data obtained when a target casting is produced and relation between gas flow rate Q ($m^3/s$) and pressure loss p (Pa) in the discharged gas suppressing means, measured by a method as shown in FIG. 2, and others. In this method, the discharged gas suppressing means which satisfies the formula (1) is used, thereby keeping a ventilation suitable for this system. Therefore, the control of the ventilation of the discharging passage is not particularly required. However, the ventilation of the discharging passage may be further controlled.

In any of the methods, it is preferable to satisfy the following: $0.3K^* \leqq K \leqq 10K^*$, more preferably $0.4^* \leqq K \leqq 5K^*$. If $K<0.3K^*$, generated gas is not smoothly discharged from the mold, so that residue defects are generated. If $K>10K^*$, the back pressure based on generated gas is small and the molten metal inside the mold is disturbed. Thus, residue defects are generated.

The control of the ventilation of the discharging passage based on the formula (1) is theoretically prescribed on the basis of the following: the back pressure based on generated gas can be approximately obtained by presuming that the decomposition speed of the pattern is equal to the metal rising speed of the molten metal in the mold. By applying this back pressure to the Bernoulli formula, an approximate solution of time for the casting is calculated. It is understood according to this that the effect of the casting time by the discharged gas controlling means is represented by as a function of K/K*. Herein, K is a value decided from the following formula (3) by a ventilation test on the basis of a formula by Ergun et al., which will be described later. K* is defined by the following formula (2). Thus, K* has been considered as a criterion of the control of the ventilation, and then the optimum range has been decided by repeating casting experiments. This is the formula (1).

$$0.3K^* \leqq K \leqq 10K^* \tag{1}$$

[wherein K* is defined as follows:

$$K^* = \sqrt{2}c\alpha S_c/\sqrt{\rho} \tag{2}$$

ρ: density ($kg/m^3$) of the molten metal, c: flow coefficient 0.3,

α: magnifying power of the volume when the pattern is evaporated, and $S_c$: sectional area ($m^2$) of a passage for the molten metal, and K is a constant decided by applying the result of a ventilation test to the following formula (3) on the basis of the method of least squares:

$$Q=K\sqrt{p} \quad (3)$$

Q: flow rate ($m^3/s$) of the gas discharged from the discharging passage comprising the discharged gas suppressing means, and p: pressure loss (Pa) in the discharging passage comprising the discharged gas suppressing means.]

The above-mentioned formula (1) will be described. The molten metal density (p) is the density ($kg/m^3$) of the molten metal when it is cast. For example, the density of cast iron of 1400° C. temperature is 6700 $kg/m^3$ and the density of aluminum of 700° C. temperature is 2350 $kg/m^3$.

Furthermore, α is the magnifying power of the volume when the pattern is evaporated, and is the ratio of the volume of generated gas at 1 atmosphere to the volume of the pattern before being decomposed. In the case that cast iron is cast into expanded polystyrene having an expansion ratio of 50 times, α is 13. For the calculation of a about polystyrene, the following descriptions can be referred to: C. Walter, and W. Siefer (Casting Technique laboratory Report), Casting, Forging and Heat treatment No. 8, 25 (1995), and Toshitake Kanno, Mold Technique Vol. 4, No. 6, 46 (1989). For example, when gas of 650 $cm^3$ volume is generated per 1 g of polystyrene, 650 $cm^3/g$ multiplied by the density 0.02 $g/cm^3$ of a pattern having an expansion ratio of 50 times (the density of polystyrene: 1 $g/cm^3$) makes 13. The value of a is appropriately modified in accordance with the temperature of the molten metal or the expansion ratio of the expanded polystyrene.

Furthermore, c is the flow coefficient (having no unit), and is usually a value of about 0.2 to 0.8 according to "Casting Engineering" (Sangyo Tosho, 1995). In the present invention, 0.3 is adopted.

$S_c$ is the sectional area ($m^2$) of the passage for the molten metal, and the sectional area of the sprue is preferably used. In the case that plural sprues are used, the total of sectional areas of the respective sprues is adopted as this sectional area. As $S_c$, the total area of runners or gates related strongly to the sectional areas of the sprues may be used, or the minimum among the sectional areas of the sprue, the runner and the gate may be used.

The ρ, α, c and $S_c$ are data easily available when an evaporative pattern casting process is carried out, and those skilled in the art can easily calculate K*.

In the present invention, the value K* is preferably from $10^{-6}$ to $1\times10^{-2}$, more preferably from $1\times10^{-5}$ to $5\times10^{-3}$. This range is particularly preferable in the case that the molten metal is cast iron.

Next, K can be understood as a constant characterizing the ventilation of the discharged gas suppressing means, and this is decided by measuring the flow rate Q ($m^3/s$) of discharged gas and the pressure loss p (Pa) about a discharged gas suppressing means to be adopted, using a device as shown in FIG. 2. The flow rate of the gas in this measurement of the ventilation is preferably measured in the range of 0.01 to 10 times the flow rate of the generated gas calculated from the volume of the pattern and the casting time. In the case that the discharged gas suppressing means is a particle-filled layer as shown in FIG. 1 at this time, the pressure loss (pressure drop) in the discharged gas suppressing means is preferably presumed as a pressure loss in proportion to the square of the flow rate, for example, from Chilton-Colburn's equation or Ergun's equation, because a large amount of gas is generated in a short period of time in the evaporative pattern casting process.

Figure 3:
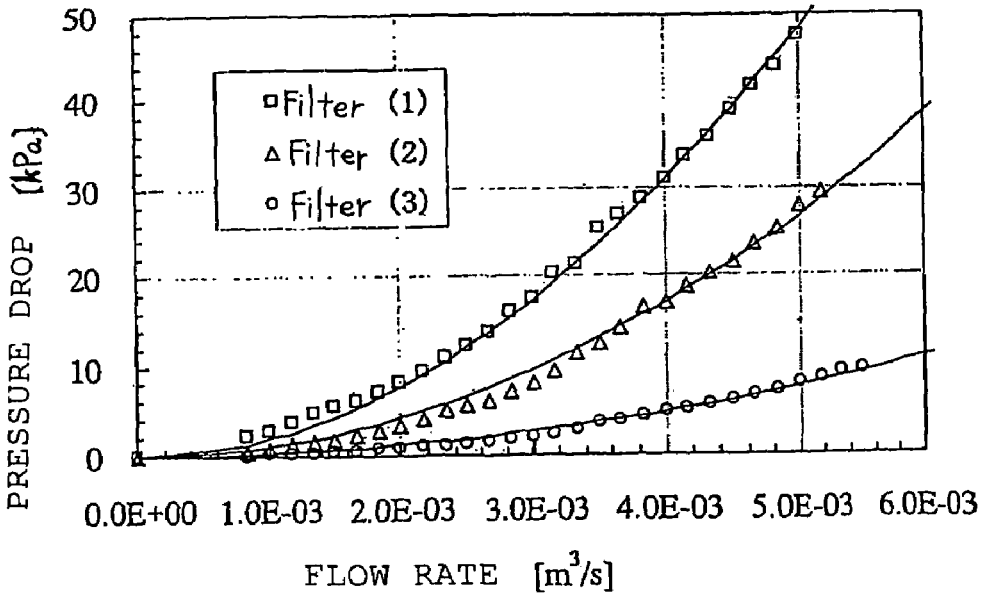
FIG. 3 is a graph showing a relationship between the gas flow rate and the pressure drop of the discharged gas suppressing means.

A specific relationship between the gas flow rate and the pressure loss in the discharged gas suppressing means is shown in FIG. 3. FIG. 3 is a graph showing a relationship between gas flow rate and pressure loss about each of a filter (1) (refractory aggregate spheres having a particle size of 0.5 mm were filled into an earthenware pipe having a diameter of 40 mm so as to have a thickness of 25 mm), a filter (2) (alumina particles having a particle size of 2 mm were filled into an earthenware pipe having a diameter of 40 mm so as to have a thickness of 100 mm) and a filter (3) (alumina particles having a particle size of 5 mm were filled into an earthenware pipe having a diameter of 40 mm so as to have a thickness of 100 mm), which were used in Examples, which will be described later. Solid lines in the graph of FIG. 3 show results that the measured values are rearranged on the basis of the formula (3) by use of the method of least squares. When K for each of the filters is obtained from the solid lines, the filter (1) has $K=2.28\times10^{-5}$ [$m^3/(Pa^{1/2}\cdot s)$)]the filter (2) has $K=3.06\times10^{-5}$ [$m^3(Pa^1/2\cdot s)$] and the filter (3) has $K=5.75\times10^{-5}$ [$m^3/(Pa_{1/2}\cdot s)$].

Accordingly, K* is calculated from an evaporative pattern casting process plan to be carried out, and a filter having K satisfying the formula (1) is selected and used, whereby a method plan capable of attaining the optimum ventilation is easily provided.

In the case that plural discharged gas suppressing means are used in the present invention, the total of K of the respective discharged gas suppressing means is treated as K in the formula (1). That is, in the case of using, for example, two filters of the above-mentioned filters (1) and (2), K in the formula (1) becomes $2.28\times10^{-5}+3.06\times10^{-5}=5.34\times10^{-5}$ [$m^3/(Pa^{1/2}\cdot s)$]. It can be expected that in the case of setting up plural discharged gas suppressing means, the effect that the pressure in the mold is uniformed usually becomes higher than the case of setting up one discharged gas suppressing means.

K of the discharged gas suppressing means can be adjusted by changing the particle sizes of the filled refractory material particles, the thickness of the layer thereof, the diameter of the discharging passage, or the like. In the case of using a hollow fine tube as the discharged gas suppressing means, K thereof can be adjusted by changing the diameter and the length thereof.

In the present invention, the K value, which should satisfy the formula (1), is preferably from $1\times10^{-6}$ to $1\times10^{-1}$, more preferably from $5\times10^{-6}$ to $5\times10^{-2}$. This range is particularly preferable in the case that the molten metal is cast iron.

As the gas-permeable refractory material layer used as the discharged gas suppressing means of the present invention, there can be used a molded article of refractory material particles to which a binder and others are added; the so-called ceramic foam filter, which is obtained by immersing a urethane foam with ceramic slurry and then firing the resultant; or the like. The former is preferable. The average particle size of the refractory material particles is from 0.1 to 10 mm, preferably from 0.5 to 5 mm, and examples thereof include particles of a metal or an oxide thereof, for example, alumina, silicate sand, zircon sand, chromite sand and synthetic ceramic sand. The refractory material is preferably filled in such an amount that the thickness thereof will be a value of 0.5 to 20 cm, more restrictedly a value of 1 to 10 cm, which depends upon the sectional area or the shape of the discharging passage, so as to satisfy the above-mentioned formula (1). In the case of using a hollow fine tube as the discharged gas suppressing means, the pipe is preferably a pipe which has an internal diameter of 0.1 to 5 cm and a length of 30 cm to 5 m, more restrictedly an internal diameter of 0.5 cm to 2 cm and a length of 40 cm to 2 m, and which is made of a refractory material such as a metal.

The back pressure valve is a valve making it possible that about the pressure of gas in the flowing direction thereof the pressure on the rear side (the downstream channel of the gas) can be made lower than that on the front side (the upstream channel of the gas). Anyone of a spring type low-pressure valve, a needle type, and others may be used. By setting up these in the discharging passage, the discharged gas suppressing means is formed.

The diameter, the setting position, the number and others of the discharging pipe(s), which become(s) the discharging passage(s), which should satisfy the above-mentioned formula (1), are decided on the basis of the material, the shape and the size of the pattern. The discharging passage is preferably made of a cylindrical exhaust pipe which has a diameter of 30 cm or less, preferably 1 to 10 cm, and which is preferably made of a ceramic. The number of the discharging passages may be appropriately decided in such a manner that a desired ventilation can be kept. One discharging pipe is preferably set up per 1000 to 100000 $cm^3$ of the foamed material, preferably 1000 to 10000 $cm^3$ thereof. In the case of using a hollow fine tube as the suppressing means, the fine tube may be fitted directly to the pattern.

As the pattern, a pattern made of an expanded synthetic resin is used. As the expanded synthetic resin, an expanded material of polystyrene, poly(methyl methacrylate), a copolymer thereof, or the like is used.

A through hole is preferably made in the pattern. It is preferable to make a through hole connected to the discharging passage 8 comprising the discharged gas suppressing means and/or the runner 10. Furthermore, preferable is a through hole connected to the discharging passage 8 and the runner 10 in order to control slow release of thermal decomposition gas precisely. The through hole may be made when the pattern is produced, or may be made with a heated metal rod, a drill, or a laser after the pattern is produced. The through hole may be made by making a notch with a cutter knife or the like and then sticking an adhesive tape or the like onto the surface of the pattern. The diameter of the through hole, the position where the hole is made, the number of the hole(s), and others are decided on the basis of the material, the shape and the size of the pattern. In the case that the through hole can be made only in a position which is not connected to the runner or the discharging passage by limitation based on a means for making the through hole, the shape of the pattern, or the like, it is preferable to make the through hole as near as possible to the runner or the discharging passage.

A coating material layer is made, on the pattern, from a coating material. Since it is not so necessary to discharge gas through the coating material film, it is possible to use, as the coating material, not only commercially available one but also a compound lubricant comprising a refractory aggregate made of fine particles of 10 μm or less particle size, preferably 1 to 10 μm particle size. This lubricant has been so far unable to be used in any full mold method. This causes an improvement in the surface smoothness of the coating material film and an improvement in the surface smoothness of the casting. When a coating material comprising a refractory aggregate made of fine particles was used in the prior art, the ventilation of the coating material film lowered and then residue defects and gas defects increased. However, in the evaporative pattern casting process of the present invention, such a problem is overcome. By forming a coating material layer having a large thickness of 2 to 10 mm to make the strength thereof higher, it is possible to use refractory particles having a large particle size (1 mm or more) so as to improve the sand compaction thereof. Examples of the refractory aggregate in the coating material include graphite, zircon, magnesia, alumina and silica.

It is preferable from the viewpoint of the strength in the coating material layer to add, as binders in the compound lubricant, water-soluble polymers such as sodium polyacrylate, starch, methylcellulose, polyvinyl alcohol, sodium arginate and gum arabic, and emulsions of various resins, such as a vinyl acetate type for a water-system; or various resins soluble or dispersible in alcohol for a alcohol-system. The added amount thereof is preferably from 0.5 to 10 parts by weight per 100 parts by weight of the refractory aggregate.

As the molding sand used for casting, there is used new sand or reclaimed sand such as silicate sand made mainly of quartz, zircon sand, chromite sand, and synthetic ceramic sand. The molding sand can be used without any binder being added thereto. In this case, the sand compaction thereof is good. However, in the case that strength is required, it is preferable to add a binder to the molding sand and then harden the mixture with a hardener.

In order to obtain a good quality casting, it is important to control the discharged speed of generated gas in any evaporative pattern casting process. However, in an actual working spot, the discharged speed of generated gas is controlled by adjusting the ventilation or the thickness of the coating material film on the basis of worker's experience. However, this is poor in reproducibility, and further it is difficult to say that this is efficient. On the other hand, the method for controlling the ventilation through the discharging passage on the basis of at least the material and the shape of the pattern, and the kind and the temperature of the molten metal, as in the present invention, can provide a clear working guideline in any evaporative pattern casting process; therefore, this method is very useful in the art.

According to the present invention, the optimum ventilation of the discharging passage can be easily decided from the material and the shape of the pattern, and others. As a result, generated gas is properly discharged outside. Therefore, residue defects can be reduced more constantly than in the prior art.

EXAMPLES

Example 1

Figure 4:
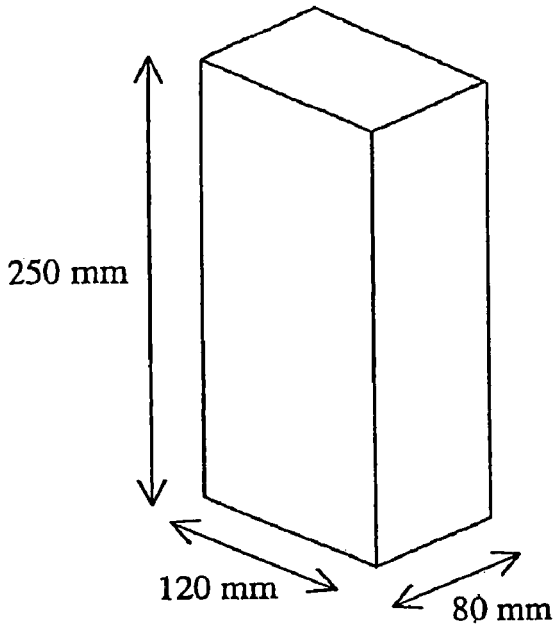
FIG. 4 is a schematic view of an expanded pattern (sample 1) used in Example 1.
Figure 5:
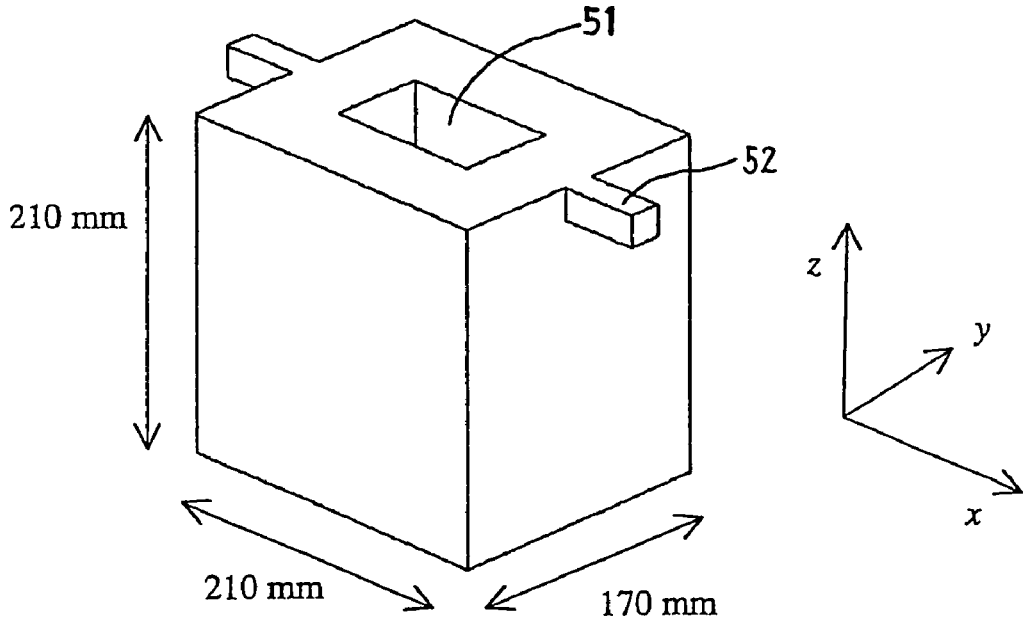
FIG. 5 is a schematic view of an expanded pattern (sample 2) used in Example 1.
Figure 6:
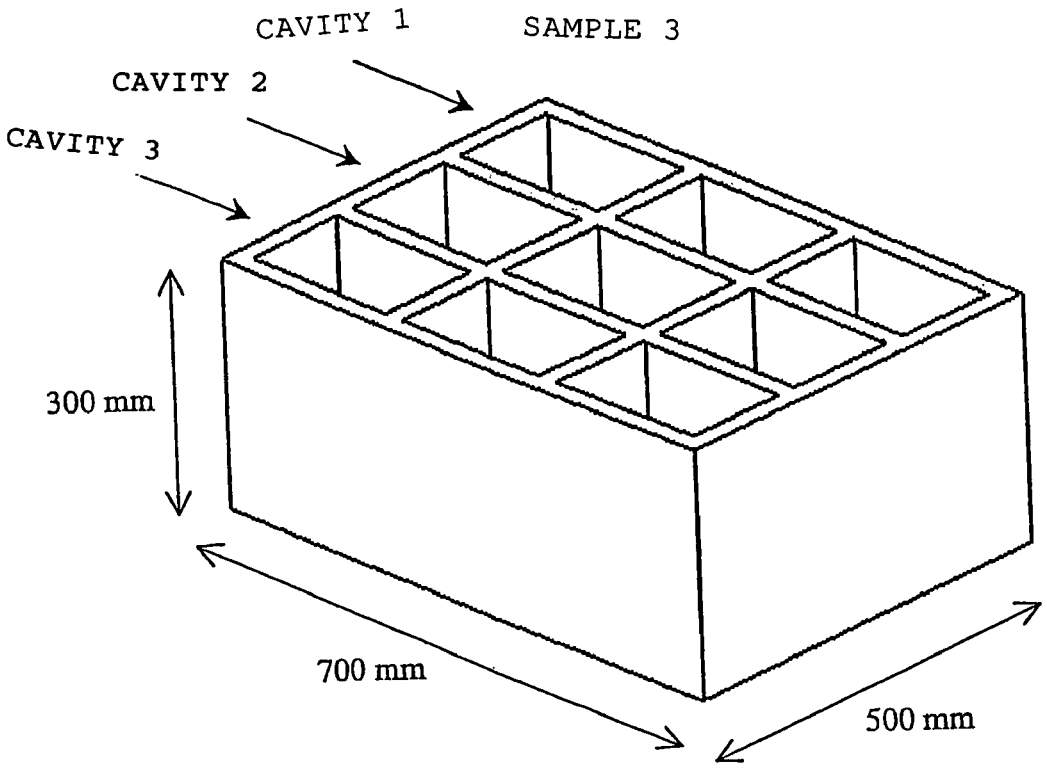
FIG. 6 is a schematic view of an expanded pattern (sample 3) used in Example 1.
Figure 9:
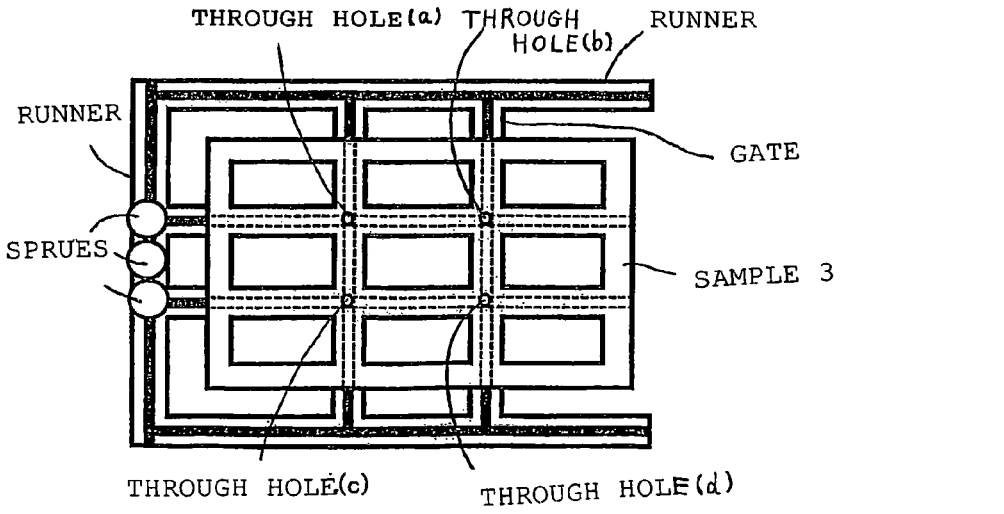
FIG. 9 is a schematic view showing a positional relationship between sample 3, sprues and runners in a mold.

Evaporative patterns (which were each made of expanded polystyrene) illustrated in FIGS. 4 to 6 were set as illustrated in FIG. 1 (but sample 3 was set as illustrated in FIG. 9) to perform evaporative pattern casting. Hereinafter, the patterns in FIG. 4, FIG. 5 and FIG. 6 are referred to as samples 1, 2 and 3, respectively.

In sample 2, about the size of a cavity 51, the length in the x direction in FIG. 5 was 100 mm, that in the y direction was 60 mm, and that in the z direction was 155 mm, and about the size of projections 52, the length in the x direction was 50 mm, that in the y direction was 20 mm, and that in the z direction was 20 mm.

In sample 3, the size of cavities 1 and 3 was 200 mm wide×130 mm long, and 275 mm deep, and the size of a cavity 2 was 200 mm wide×140 mm long, and 275 mm deep (the thickness of an outer frame and partitions: 25 mm).

Figure 7:
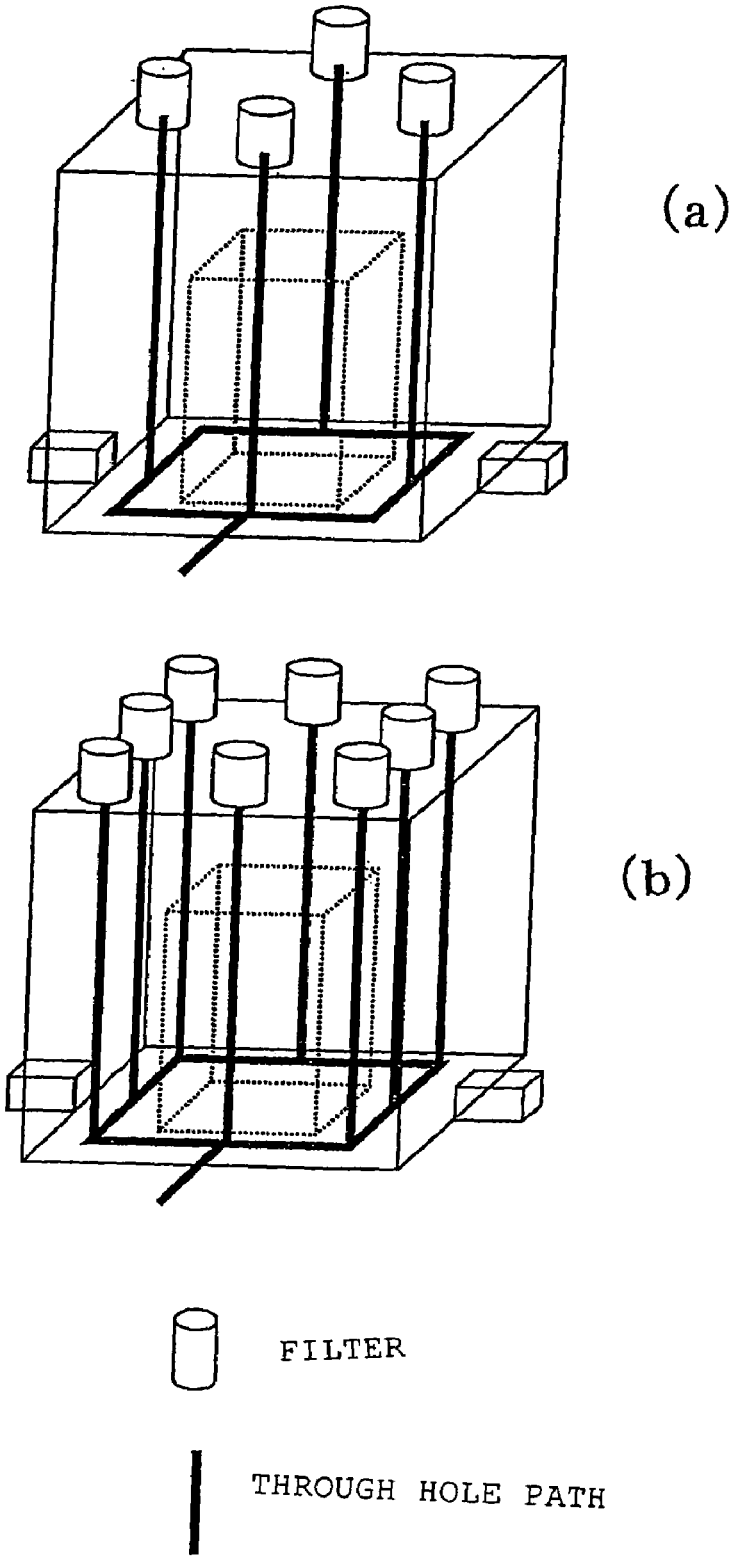
FIG. 7 are schematic views illustrating positions where through holes are made and positions where filters are set in sample 2.

Situations that through holes are made in sample 2 and positions where filters are set up therein are schematically illustrated in FIG. 7. FIG. 7(*a*) is a schematic view of a case wherein four filters are setup, and FIG. 7(*b*) is a schematic view of a case wherein eight filters are set up. Sample 2 was embedded, in a state illustrated in FIG. 7, in molding sand.

Figure 8:
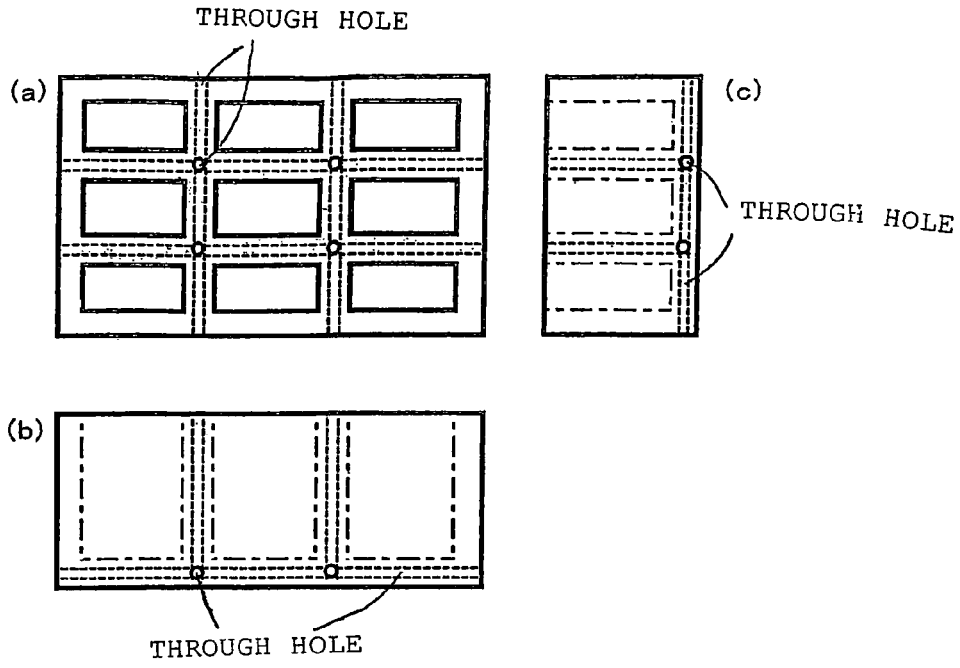
FIG. 8 are schematic views illustrating positions where through holes are made in sample 3.

A situation that through holes are made in sample 3 is schematically illustrated in FIG. 8, and the setting position of sample 3 is schematically illustrated in FIG. 9. In the case that two filters are set up in sample 3, the filters are set to be connected to through holes (a) and (d) in FIG. 9. In the case that four filters are set up in sample 3, the filters are set to be connected to through holes (a) to (d) in FIG. 9. In sample 3, runners and gates are made of expanded polystyrene. Through holes are made in the runners and the gates in such a manner that the through holes are connected to each other. The through holes are connected to sprues and further connected to through holes in sample 3. In test Nos. 7 and 8 using sample 3, three sprues were made, and the total of the sectional areas of the respective sprues was adopted as $S_c$.

At the time of casting, the filters illustrated in Table 1 were used in combination shown in Table 2 as a discharging passage comprising a discharged gas suppressing means.

The surfaces of samples 1 and 2 were coated with a coating material of 80 Baume degrees, and the surface of sample 3 was coated with a coating material of 70 Baume degrees, and the lubricants were dried. Thereafter, molds were formed. The composition of the coating materials was as follows: 40% by weight of silica powder (average particle size: 8 μm), 10% by weight of vein graphite, 5% by weight of a vinyl acetate type binder, 40% by weight of water, 0.5% by weight of a nonionic surfactant, and 4.5% by weight of bentonite. The material quality of the cast iron was FC-250, and the casting temperature was 1400° C.

About samples 1 and 2 (that is, test Nos. 1 to 6), the length of the sprue was set into 45 cm. About sample 3 (that is, test Nos. 7 and 8), the length of each of the three sprues was set into 53 cm. About the cast iron which was a casting material in the present example, p was 6700 kg/m$^2$ at a casting temperature of 1400° C., and a was set into 13, correspondingly to the casting temperature. The value c was 0.3. The sectional area $S_c$ of the sprue(s) was changed to adjust K*.

Table 2 shows the samples, K*, K, combinations of the filters, and evaluation results using quality of cast product by a visual inspection.

For reference, in the case that the ventilation of the filter is poor and the casting time is long, the sooting of generated gas (the cyclization of the styrene monomer) is promoted and carbon residue defects are generated mainly on the upper face or the side face of the casting. In the case that the ventilation of the filter is excessively large and the casting time is short, the molten metal inside the mold is disturbed and the pattern is caught therein to cause carbon residue defects.

TABLE 1

| Filter | | |
|---|---|---|
| Symbol | Structure | $K_1$ [m$^3$/(Pa$^{1/2}$ · s] |
| Filter (1) | obtained by filling a cylindrical-shaped earthenware pipe having an inner diameter of 40 mm with refractory aggregate spheres having an average particle size of 0.5 mm, comprising an ester-setting phenol resin so as to have a thickness of 25 mm and then curing it. | $2.28 \times 10^{-5}$ |
| Filter (2) | obtained by filling a cylindrical-shaped earthenware pipe having an inner diameter of 40 mm with almina particles having an average particle size of 2 mm, comprising an ester-setting phenol resin so as to have a thickness of 100 mm and then curing it. | $3.06 \times 10^{-5}$ |
| Filter (3) | obtained by filling a cylindrical-shaped earthenware pipe having an inner diameter of 40 mm with almina particles having an average particle size of 5 mm, comprising an ester-setting phenol resin so as to have a thickness of 100 mm and then curing it. | $5.75 \times 10^{-5}$ |
| Filter (4) | obtained by filling a cylindrical-shaped earthenware pipe having an inner diameter of 40 mm with almina particles having an average particle size of 2 mm, comprising an ester-setting phenol resin so as to have a thickness of 25 mm and then curing it. | $6.03 \times 10^{-5}$ |

*$K_1$ is the value of K per filter.

TABLE 2

| Test No. | Foamed pattern | Casting weight (kg) | Sectional area of the sprue (m$^2$) | K* [m$^3$/(Pa$^{1/2}$ · s)] | Used filter Symbol | Number | K [m$^3$/Pa$^{1/2}$ · s)] | K/K* | Quality of cast product |
|---|---|---|---|---|---|---|---|---|---|
| 1 | Sample 1 | 16 | $7.07 \times 10^{-4}$ | $4.76 \times 10^{-5}$ | Filter (1) | One | $2.28 \times 10^{-5}$ | 0.48 | No residue defects were observed. |
| 2 | | | $7.07 \times 10^{-4}$ | $4.76 \times 10^{-5}$ | Filter (2) | One | $3.06 \times 10^{-5}$ | 0.64 | No residue defects were observed. |
| 3 | | | $7.07 \times 10^{-4}$ | $4.76 \times 10^{-5}$ | Filter (4) | One | $6.03 \times 10^{-5}$ | 1.27 | No residue defects were observed. |
| 4 | Sample 2 | 45 | $7.07 \times 10^{-4}$ | $4.76 \times 10^{-5}$ | Filter (4) | Four | $2.41 \times 10^{-4}$ | 5.06 | Slight residue defects were on the upper face and the side face. |
| 5 | | | $7.07 \times 10^{-4}$ | $4.76 \times 10^{-5}$ | Filter (4) | Eight | $4.82 \times 10^{-4}$ | 10.1 | Large resiue defects were on the upper face. |
| 6 | | | $3.14 \times 10^{-4}$ | $2.12 \times 10^{-5}$ | Filter (4) | Four | $2.41 \times 10^{-4}$ | 11.4 | Large resiue defects were on the upper face. |

TABLE 2-continued

| Test No. | Foamed pattern | Casting weight (kg) | Sectional area of the sprue ($m^2$) | K* [$m^3/(Pa^{1/2} \cdot s)$] | Used filter Symbol | Number | K [$m^3/Pa^{1/2} \cdot s)$] | K/K* | Quality of cast product |
|---|---|---|---|---|---|---|---|---|---|
| 7 | Sample 3 | 280 | $3.77 \times 10^{-3}$ | $2.54 \times 10^{-4}$ | Filter (3) | Two | $1.15 \times 10^{-4}$ | 0.45 | Residue defects ware hardly observed. |
| 8 | | | $3.77 \times 10^{-3}$ | $2.54 \times 10^{-4}$ | Filter (3) | Four | $2.30 \times 10^{-4}$ | 0.91 | No residue defects were observed. |

The invention claimed is:

1. An evaporative pattern casting process for casting a product, which comprises pouring a molten metal in a mold in which a pattern made of an expanded synthetic resin is embedded in molding sand, and evaporating the pattern with the molten metal, while gas generated by evaporation of the pattern is discharged outside the mold through a discharging passage comprising a discharged gas suppressing means, wherein the ventilation of the discharging passage is controlled on the basis of the material and the shape of the pattern and the kind of the molten metal and the temperature of the molten metal, wherein the ventilation of the discharging passage is controlled on the basis of the following formula (1):

$$0.3K^* \leqq K \leqq 10K^* \quad (1)$$

wherein K* is defined as follows:

$$K^* = \sqrt{2}c\alpha S_c/\sqrt{\rho} \quad (2)$$

ρ: density ($kg/m^3$) of the molten metal, c: flow coefficient 0.3,

α: magnifying power of the volume when the pattern is evaporated, and $S_c$: sectional area ($m^2$) of the passage for the molten metal, and K is a constant decided by applying the result of a ventilation test to the following formula (3) on the basis of the method of least squares:

$$Q = K\sqrt{k} \quad (3)$$

Q: flow rate ($m^3/s$) of the gas discharged from the discharging passage comprising the discharged gas suppressing means, and p: pressure loss (Pa) in the discharging passage comprising the discharged gas suppressing means.

2. The evaporative pattern casting process according to claim 1, wherein the ventilation of the discharging passage is controlled on the basis of the material and the shape of the pattern, the density of the molten metal, which is decided by the kind of the molten metal and the temperature of the molten metal, the sectional area of a passage for the molten metal, and the magnifying power of the volume when the pattern is evaporated.

3. The evaporative pattern casting process according to claim 2, wherein the sectional area of a sprue is used as the sectional area of the passage for the molten metal.

4. An evaporative pattern casting process for casting a product, which comprises pouring a molten metal in a mold in which a pattern made of an expanded synthetic resin is embedded in molding sand, and evaporating the pattern with the molten metal, while gas generated by evaporation of the pattern is discharged outside the mold through a discharging passage comprising a discharged gas suppressing means satisfying the following formula (1):

$$0.3K^* \leqq K \leqq 10K^* \quad (1)$$

wherein K* is defined as follows:

$$K^* = \sqrt{2}c\alpha S_c/\sqrt{\rho} \quad (2)$$

ρ: density ($kg/m^3$) of the molten metal, c: flow coefficient 0.3,

α: magnifying power of the volume when the pattern is evaporated, and $S_c$: sectional area ($m^2$) of a passage for the molten metal, and K is a constant decided by applying the result of a ventilation test to the following formula (3) on the basis of the method of least squares:

$$Q = K\sqrt{p} \quad (3)$$

Q: flow rate ($m^3/s$) of the gas discharged from the discharging passage comprising the discharged gas suppressing means, and p: pressure loss (Pa) in the discharging passage comprising the discharged gas suppressing means.

5. A method of controlling the ventilation of the discharging passage on the basis of the material and the shape of the pattern and the kind of the molten metal and the temperature of the molten metal in an evaporative pattern casting process for casting a product, which comprises pouring a molten metal in a mold in which a pattern made of an expanded synthetic resin is embedded in molding sand, and evaporating the pattern with the molten metal, while gas generated by evaporation of the pattern is discharged outside the mold through a discharging passage comprising a discharged gas suppressing means, wherein the ventilation of the discharging passage is controlled on the basis of the following formula (1):

$$0.3K^* \leqq K \leqq 10K^* \quad (1)$$

wherein K* is defined as follows:

$$K^* = \sqrt{2}c\alpha S_c/\sqrt{\rho} \quad (2)$$

ρ: density ($kg/m^3$) of the molten metal, c: flow coefficient 0.3,

α: magnifying power of the volume when the pattern is evaporated, and $S_c$: sectional area ($m^2$) of a passage for the molten metal, and K is a constant decided by applying the result of a ventilation test to the following formula (3) on the basis of the method of least squares:

$$Q = K\sqrt{p} \quad (3)$$

Q: flow rate ($m^3/s$) of the gas discharged from the discharging passage comprising the discharged gas suppressing means, and p: pressure loss (Pa) in the discharging passage comprising the discharged gas suppressing means.

6. The evaporative pattern casting process according to claim 1 or 4, wherein the expanded synthetic resin is polystyrene, poly(methyl methacrylate) or a copolymer thereof.

7. The evaporative pattern casting process according to claim 4, wherein the K* value is from $5\times10^{-6}$ to $1\times10^{-2}$.

8. The evaporative pattern casting process according to claim 4, wherein the $S_c$ is the smallest among sectional areas of a sprue, a runner, and a gate.

9. The evaporative pattern casting process according to claim 1 or 4, wherein a plurality of the discharged gas suppressing means are used.

10. The evaporative pattern casting process according to claim 4, wherein the K value is from $1\times10^{-6}$ to $1\times10^{-1}$.

11. The evaporative pattern casting process according to claim 1 or 4, wherein a through hole is made in the pattern.

* * * * *